US011723499B2

(12) United States Patent
Leffler et al.

(10) Patent No.: US 11,723,499 B2
(45) Date of Patent: Aug. 15, 2023

(54) VACUUM CLEANER NOZZLE

(71) Applicant: Aktiebolaget Electrolux, Stockholm (SE)

(72) Inventors: Jens Leffler, Stockholm (SE); Erik Dahlbeck, Stockholm (SE); Josef Isaksson, Stockholm (SE); Fredrik Franzén, Stockholm (SE)

(73) Assignee: Aktiebolaget Electrolux

( * ) Notice: Subject to any disclaimer, the term of this patent is extended or adjusted under 35 U.S.C. 154(b) by 0 days.

(21) Appl. No.: 17/617,444

(22) PCT Filed: Jun. 11, 2019

(86) PCT No.: PCT/EP2019/065157
§ 371 (c)(1),
(2) Date: Dec. 8, 2021

(87) PCT Pub. No.: WO2020/249186
PCT Pub. Date: Dec. 17, 2020

(65) Prior Publication Data

US 2022/0240739 A1 Aug. 4, 2022

(51) Int. Cl.
*A47L 9/04* (2006.01)
*A47L 9/24* (2006.01)

(52) U.S. Cl.
CPC ..... *A47L 9/0477* (2013.01); *A47L 9/242* (2013.01); *A47L 9/248* (2013.01)

(58) Field of Classification Search
CPC ... A47L 9/02; A47L 9/242; A47L 9/04; A47L 9/0405; A47L 9/0477; A47L 9/248
USPC ..... 15/416, 368, 366, 395, 383
See application file for complete search history.

(56) References Cited

U.S. PATENT DOCUMENTS 6,209,925 B1 4/2001 Edin
6,519,810 B2 2/2003 Kim
6,553,613 B2 4/2003 Onishi et al.
7,386,917 B2 * 6/2008 Gogel ..... A47L 9/242 285/7

(Continued)

FOREIGN PATENT DOCUMENTS

CN 1321457 A 11/2001
CN 1406552 A 4/2003

(Continued)

OTHER PUBLICATIONS

International Search Report and Written Opinion for International Application No. PCT/EP2019/065157, dated Mar. 11, 2020, 8 pages.

(Continued)

*Primary Examiner* — Don M Anderson
*Assistant Examiner* — Sarah Akyaa Fordjour
(74) *Attorney, Agent, or Firm* — RatnerPrestia

(57) ABSTRACT

A vacuum cleaner nozzle, having a connector socket, pivotally connected to the nozzle by a joint. The connector socket has an inner tubular opening configured to receive a vacuum cleaner tube. A connector socket release mechanism, has a locking member, moveable between a first position, where it is inserted in the tubular opening of the connector socket in order to retain the vacuum cleaner tube therein, and a second position, where it is forced out of the tubular opening by a movement in the joint, in order to release the vacuum cleaner tube.

11 Claims, 3 Drawing Sheets

(56) References Cited

U.S. PATENT DOCUMENTS

| | | | | |
|---|---|---|---|---|
| 7,891,050 | B2 | 2/2011 | Liddell | |
| 2002/0194699 | A1 | 12/2002 | Hunter et al. | |
| 2003/0140449 | A1* | 7/2003 | Alton | A47L 9/02 15/375 |
| 2005/0115017 | A1 | 6/2005 | Kim | |

FOREIGN PATENT DOCUMENTS

| | | | |
|---|---|---|---|
| CN | 1623487 | A | 6/2005 |
| CN | 1997308 | A | 7/2007 |
| DE | 8116024 | U1 | 10/1981 |
| EP | 0884018 | A1 | 12/1998 |
| JP | 06311948 | A | 11/1994 |
| JP | 2005287659 | A | 10/2005 |
| JP | 2009201686 | A | 9/2009 |
| JP | 2011024840 | A | 2/2011 |
| JP | 2018122031 | A | 8/2018 |
| RU | 2183420 | C1 | 6/2002 |

OTHER PUBLICATIONS

Chinese Office Action for Chinese Application No. 201980097355.8, dated Nov. 1, 2022 with translation, 15 pages.

Japanese Notice of Reasons for Refusal for Japanese Application No. 2021-572306, dated Jun. 27, 2023 with translation, 6 pages.

* cited by examiner

VACUUM CLEANER NOZZLE

This application is a U.S. National Phase application of PCT International Application No. PCT/EP2019/065157, filed Jun. 11, 2019, which is incorporated by reference herein.

FIELD OF THE INVENTION

The present disclosure relates to a vacuum cleaner nozzle, comprising a connector socket, pivotally connected to the nozzle by means of a joint, the connector socket comprising an inner tubular opening configured to receive a vacuum cleaner tube.

TECHNICAL BACKGROUND

Such a vacuum cleaner nozzle is shown for instance in DE-8116024-U. A general problem associated with vacuum cleaner nozzles of this kind is how to make them easier to use, for instance to disconnect the vacuum cleaner nozzle therefrom in an easy and reliable manner.

SUMMARY OF THE INVENTION

One object of the present disclosure is therefore to provide a vacuum cleaner nozzle that is easier to use.

This object is achieved by means of a vacuum cleaner nozzle as defined in claim 1. More particularly, in a vacuum cleaner nozzle of the initially mentioned kind, there is provided a connector socket release mechanism, comprising a locking member, moveable between a first position, where it is inserted in the tubular opening of the connector socket in order to retain the vacuum cleaner tube therein, and a second position, being forced out of the tubular opening by a movement in said joint, in order to release the vacuum cleaner tube.

With such a configuration, it is sufficient to move the connector socket to the second position, typically by moving the vacuum cleaner tube, to be able to release the tube from the nozzle. This operation does not require the user reaching down to the nozzle on the floor and is relatively easy.

The connector socket release mechanism may comprise a lever having the locking member in the form of a tip at one end, a pivot, and another, free end. The other, free end may be urged by a nozzle part on the other side of the joint when the connector socket is oriented in an upright position, thereby shifting said connector socket release mechanism to the second position.

The locking member may be retracted from the tubular opening in a position where the connector socket is oriented in a direction deviating less than 25 degrees from a vertical direction.

The other, free end may be urged by a cover of the nozzle when the connector socket is oriented in the upright position.

The lever may be made in one piece, typically by injection molding, and the release mechanism may be biased by a spring towards the first position.

The inner tubular opening may be non-circular in cross section, such that the vacuum cleaner tube does not turn therein.

The connector socket release mechanism may further comprise a push button which is accessible to force the connector socket release mechanism to the second position. This provides an alternative method to release the tube from the nozzle.

The present disclosure also relates to a vacuum cleaner comprising a vacuum cleaner tube and a nozzle as outlined above. Such a vacuum cleaner tube may comprise a notch for receiving the release mechanism locking member.

DETAILED DESCRIPTION

Figure 1:
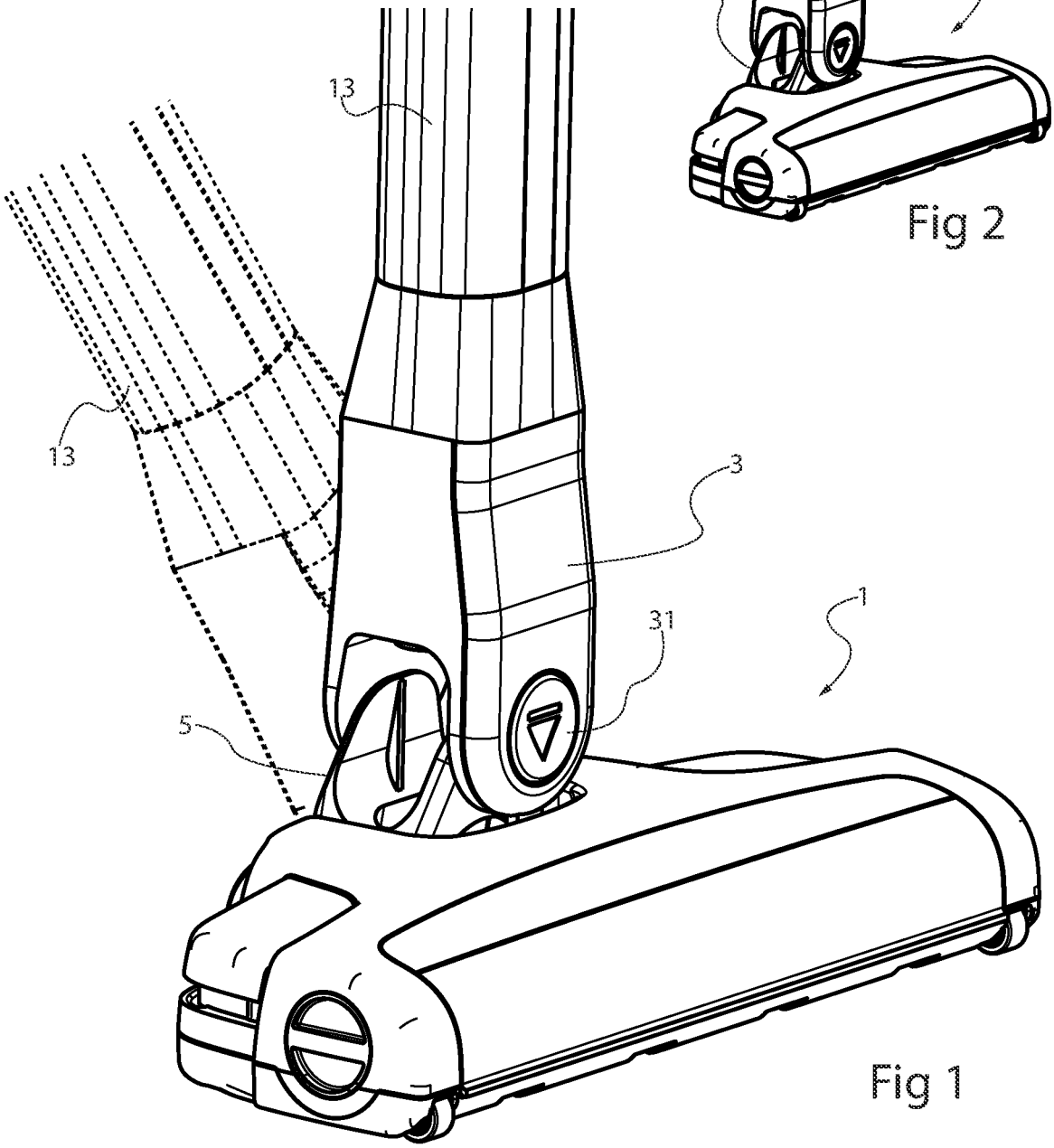
FIG. 1 shows a vacuum cleaner nozzle with a connected vacuum cleaner tube in a release position and with an indicated cleaning position.

The present disclosure relates generally to vacuum cleaner nozzles. FIG. 1 shows a vacuum cleaner nozzle 1, with a vacuum cleaner tube 13 attached to a connector socket 3 of the nozzle 1. The connector socket 3 is set in what is defined as a release position where the vacuum cleaner tube 13 can be released from the connector socket 3 of the nozzle 1. The nozzle 1 comprises a joint 5 via which the connector socket 3 is attached, which allows the vacuum cleaner tube 13 to project in different angles from the nozzle 1, which normally rests on and moves over a floor or the like. This facilitates cleaning and is well known per se. There is also indicated in FIG. 1 (hashed lines) a cleaning position of the vacuum cleaner tube 13, although there are of course many such cleaning positions, the vacuum cleaning tube 13 for example being capable of turning about 90 degrees at the joint 5, as will be shown in connection with FIGS. 3 and 5.

Figure 2:
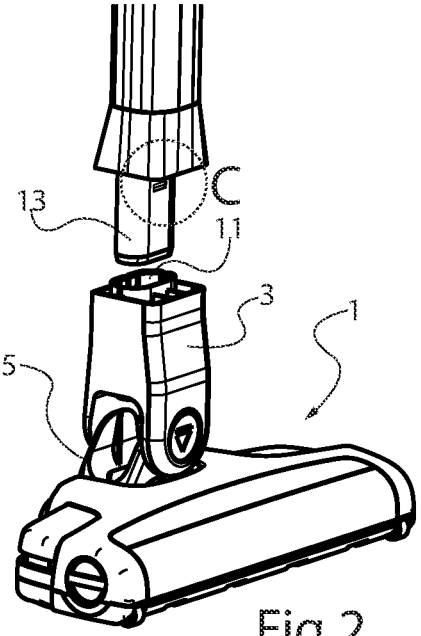
FIG. 2 shows a vacuum cleaner nozzle of FIG. 1, with the vacuum cleaner tube being disconnected in the release position.

FIG. 2 shows a vacuum cleaner nozzle 1 of FIG. 1, with the vacuum cleaner tube 13 being disconnected in the release position where the vacuum cleaner tube 13 is for instance upright. In accordance with the present disclosure there is disclosed a mechanism for releasing the vacuum cleaner tube 13 in this position, such that the user can release the tube simply by moving the tube to the release position of the nozzle 1 and pull the tube 13 out, without having to bend down to the floor to release the tube manually with a lever, button or similar.

Figure 3:
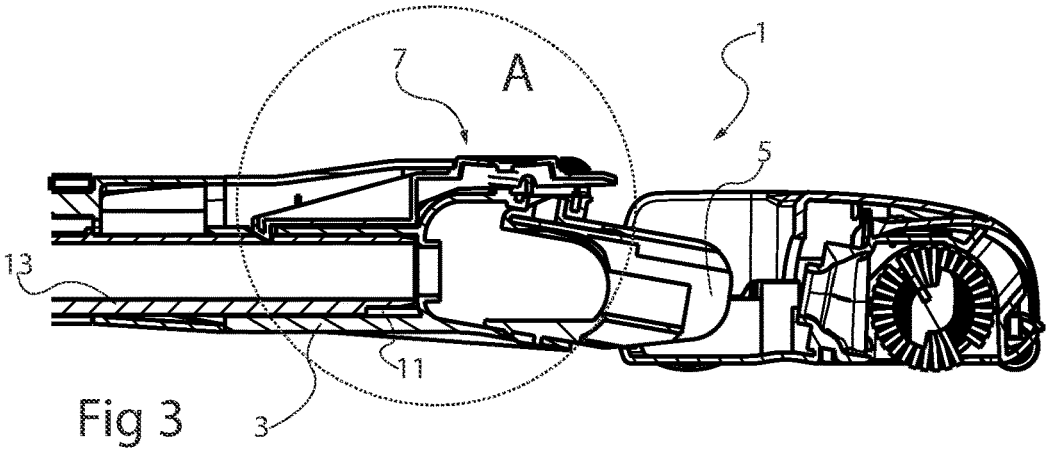
FIG. 3 shows a cross section through a vacuum cleaner nozzle with a connected vacuum cleaner tube in a cleaning position.
Figure 4:
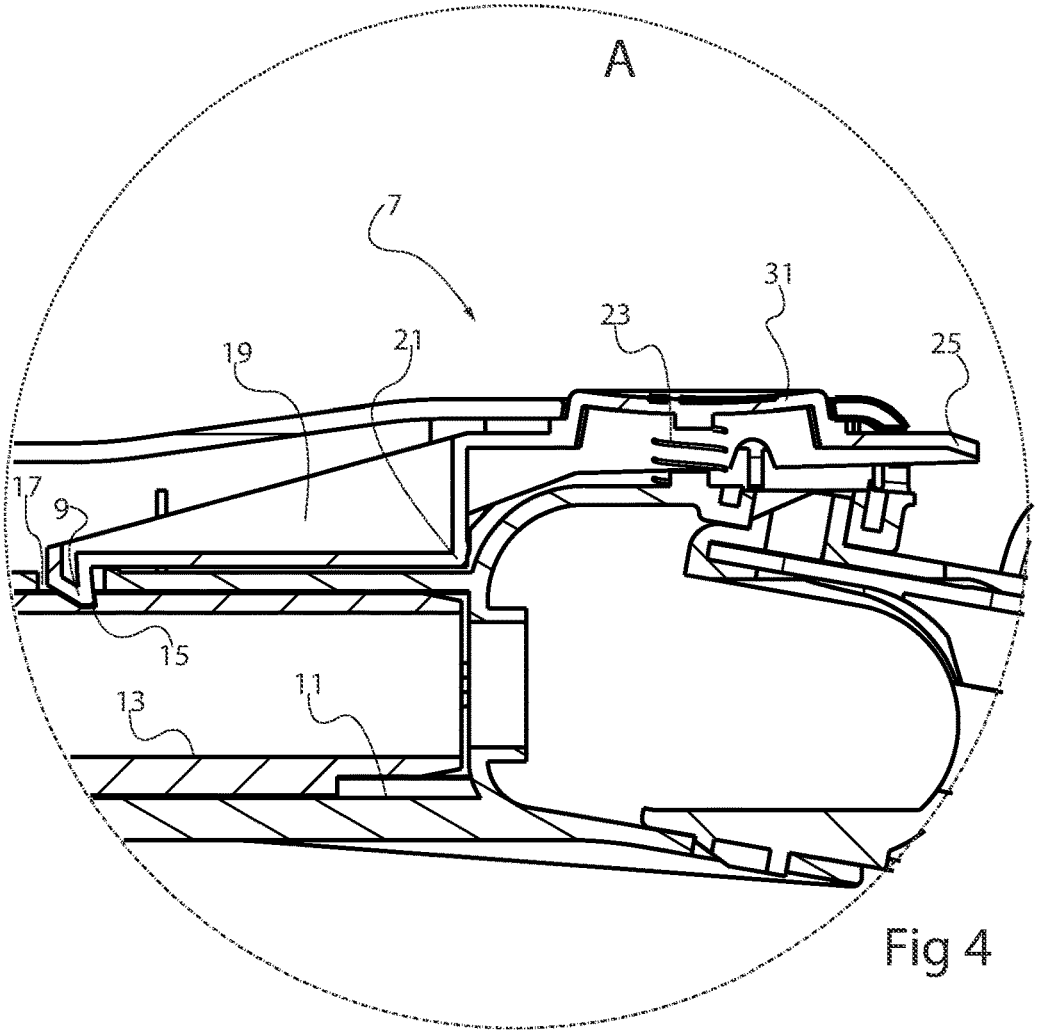
FIG. 4 shows an enlarged portion A of FIG. 3.

FIG. 3 shows a cross section through a vacuum cleaner nozzle 1 with a connected vacuum cleaner tube 13 in an example of a cleaning position, and FIG. 4 shows an enlarged portion A of FIG. 3. As illustrated, the vacuum cleaner nozzle 1 comprises a connector socket 3, pivotally connected to the nozzle by means of a joint 5 as is well known per se. The connector socket 3 and the tube 13 can therefore be moved between at least the positions illustrated in FIGS. 3 and 5.

The connector socket comprises an inner tubular opening 11 configured to receive a vacuum cleaner tube 13. The inner tubular opening 11 therefore has an inner shape corresponding to the outer shape of the vacuum cleaner tube 13, so that there is formed a mutual interface allowing the vacuum cleaner tube 13 to slide into the inner tubular opening 11 of the connector socket 3. That interface may, as illustrated in FIG. 2 be oval in cross section, even though a circular, elliptic, rectangular or polygonal shape may be considered as well. A non-circular shape may be preferred as it prevents mutual rotation between the vacuum cleaner tub 13 and the tubular opening 11 of the connector socket 3, which may make the locking and releasing arrangement to be disclosed more reliable, for instance by correctly positioning a notch that will be described.

Figure 7:
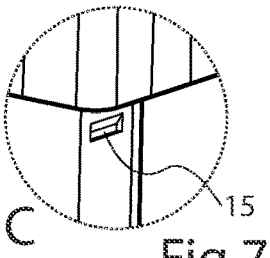
FIG. 7 shows an enlarged portion C of FIG. 2.

With reference to FIG. 7, showing an enlarged portion C of FIG. 2, there may be provided a notch 15 in the outer face of the vacuum cleaner tube 13. This forms a surface at least partly perpendicular to the tube's 13 direction of insertion in the connector socket 3, which may be used by the locking and release mechanism. However, such a perpendicular surface could be provided in other ways, and it would also be possible to dispense with such a surface relying instead on friction.

With reference again to FIG. 3, the nozzle 1 may comprise a connector socket locking and release mechanism 7. This mechanism may comprise a locking member 9, as illustrated in FIG. 4 in the form of a tip 9, which in a first position, is inserted in the tubular opening 11 of the connector socket 3 through a hole 17 in a side wall of the tubular opening 11. In this position, the tip 9 interferes with the notch 15 in the vacuum cleaner tube 13 to keep the vacuum cleaner tube 13 retained in the tubular opening 11 of the connector socket 3. The notch 15 or the like in the tube 13 is not strictly needed, friction from the tip 9 could be sufficient to provide a retaining effect, especially if the tip has a rubber-like surface and is strongly biased to enter the hole 17 by a spring as will be illustrated.

The locking member/tip 9 may be formed at one end of a lever 19, which may be more or less enclosed in the housing of the connector socket 3. This lever 19 may have a pivot 21 defining its movement. As shown, the lever 19 is biased by a helical spring 23, which may be located on the other side of the pivot 21 as seen from the locking member/tip 9. This keeps the locking member/tip 9 inserted in the hole 17 in the side wall of the tubular opening 11, thereby retaining the vacuum cleaner tube 13 until it is to be released. The lever 19 further comprises another, free end 25, located on the other side of the pivot 21 as seen from the locking member/tip 9.

The lever 19 may be made in one piece, typically by injection molding a plastic material.

The connector socket release mechanism may further comprise a push button 31 which is accessible from the outside. By pushing the button 31, the connector socket release mechanism may be forced to the second position. This provides an alternative method to release the tube from the nozzle.

Figure 5:
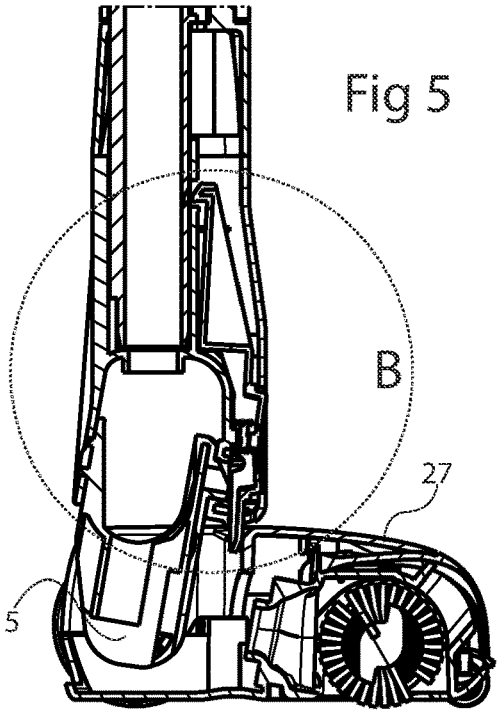
FIG. 5 shows a cross section through a vacuum cleaner nozzle with a connected vacuum cleaner tube in a release position.
Figure 6:
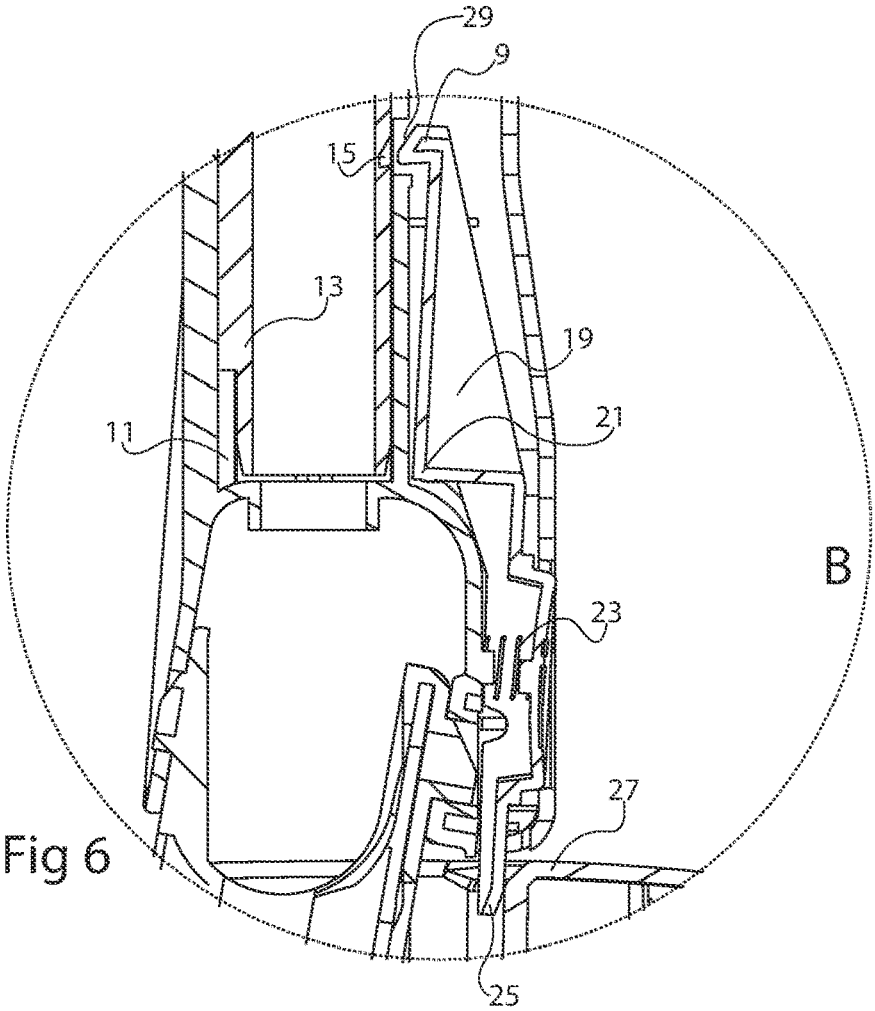
FIG. 6 shows an enlarged portion B of FIG. 5.

FIG. 5 shows a cross section through a vacuum cleaner nozzle with a connected vacuum cleaner tube in a release position, and FIG. 6 shows an enlarged portion B of FIG. 5. In the release position, the connector socket 3 is turned at the joint 5 into a relatively upright position in relation to the floor on which the nozzle 1 rests. In this position, the other, free end 25 of the lever 19 comes into contact with the cover 27 of the nozzle 1 as best seen in FIG. 6. This counteracts the bias of the spring 23, and turns the lever 19 about the pivot 21, thereby making the locking member/tip 9 move out of the tubular opening 11 such that the vacuum cleaner tube 13 can easily be removed out of the connector socket 3. As is understood, this can be done without the user reaching down to the nozzle 1.

Once the vacuum cleaner tube 13 is removed, the locking member/tip 9 may re-enter the tubular opening 11. As illustrated in FIG. 6, the locking member 9 may comprise a surface 29 slanting away from the center of the tubular opening 11 in the direction the vacuum cleaner tube 13 is removed. Thereby, the locking member 9 moves out of the way when the vacuum cleaner tube 13 is again reinserted and then snaps into the notch 15 of the vacuum cleaner tube 13 to provide a locking function.

The present disclosure is not restricted to the above-described embodiment and may be varied and altered in different ways within the scope of the appended claims.

The invention claimed is:

1. A vacuum cleaner nozzle assembly, comprising:

a nozzle;

a connector socket pivotally connected to the nozzle by a joint, the connector socket comprising:

an inner tubular opening configured to receive a vacuum cleaner tube, and a connector socket release mechanism, comprising a locking member moveable between a first position, in which the locking member is inserted in the tubular opening at a location in which the locking member retains the vacuum cleaner tube in the inner tubular opening, and a second position at a location in which the locking member does not retain the vacuum cleaner tube in the inner tubular opening, wherein a portion of the connector socket release mechanism is positioned to contact a portion of the nozzle upon a movement of the joint, to thereby move the locking member from the first position to the second position.

2. The vacuum cleaner nozzle according to claim 1, wherein the connector socket release mechanism comprises a lever having a first end with the locking member in the form of a tip at the first end, a second end, and a pivot between the first end and the second end.

3. The vacuum cleaner nozzle according to claim 2, wherein the second end is positioned to contact the portion of the nozzle when the connector socket is oriented in an upright position relative to the nozzle, thereby shifting the locking member to the second position.

4. The vacuum cleaner nozzle according to claim 3, wherein the second end is positioned to contact the portion of the nozzle to shift the locking member to the second position when the connector socket is oriented in a direction deviating less than 25 degrees from an upright vertical direction when the nozzle is positioned on a horizontal surface.

5. The vacuum cleaner nozzle according to claim 1, wherein the portion of the nozzle is a nozzle cover.

6. The vacuum cleaner nozzle according to claim 2, wherein the lever is made in one piece.

7. The vacuum cleaner nozzle according to claim 1, wherein the connector socket release mechanism further comprising a spring- configured to bias the locking member towards the first position.

8. The vacuum cleaner nozzle according to claim 1, wherein the inner tubular opening is non-circular.

9. The vacuum cleaner nozzle according to claim 1, wherein the connector socket release mechanism further comprises a push button which is accessible to force the locking member mechanism to the second position.

10. A vacuum cleaner comprising a vacuum cleaner tube and a nozzle according to claim 1.

11. The vacuum cleaner according to claim 10, wherein the vacuum cleaner tube comprises a notch configured to receive the locking member.

* * * * *